United States Patent [19]

Williams

[11] 4,281,717

[45] Aug. 4, 1981

[54] EXPOLOSION SUPPRESSION SYSTEM FOR FIRE OR EXPOLOSION SUSCEPTIBLE ENCLOSURES

[76] Inventor: Robert M. Williams, 16 La Hacienda, Ladue, Mo. 63124

[21] Appl. No.: 87,828

[22] Filed: Oct. 25, 1979

[51] Int. Cl.[3] ..... A62C 37/06

[52] U.S. Cl. ..... 169/20; 169/66; 340/514; 137/624.14

[58] Field of Search ..... 169/19, 60, 61, 66, 169/68, 20, 7, 8, 9, 56, 16; 340/506, 509, 516, 514, 527; 137/624.14; 239/67, 68, 69

[56] References Cited

U.S. PATENT DOCUMENTS

| | | | |
|---|---|---|---|
| 3,825,766 | 7/1974 | Connor et al. | 169/61 |
| 3,949,812 | 4/1976 | Hay | 169/9 |
| 3,993,138 | 11/1976 | Stevens et al. | 169/61 |

*Primary Examiner*—Robert J. Spar
*Assistant Examiner*—Kenneth Noland
*Attorney, Agent, or Firm*—Gravely, Lieder & Woodruff

[57] ABSTRACT

A system for sensing and acting to suppress flame conditions as well as an explosion associated with a flame front in an enclosure which is susceptible to fire and explosion condition, such as trash shredders, grain elevators, and enclosed areas where oxygen and combustible material may be present in the necessary proportions to feed a fire of such rapid propagation as to result in explosive proportions resulting in damage to the structure forming the enclosure. The system comprises means distributed about the enclosing structure to sense a flame as well as a sudden rise in pressure and set off a fire and explosion suppressing system which operates to flood the enclosed area with an agent capable of quenching the flame causing the pressure rise, and programmable monitoring control circuits for operating the system and all of its components during the time when a pressure rise signals the development of an explosion, and following the suppression of an explosion.

10 Claims, 6 Drawing Figures

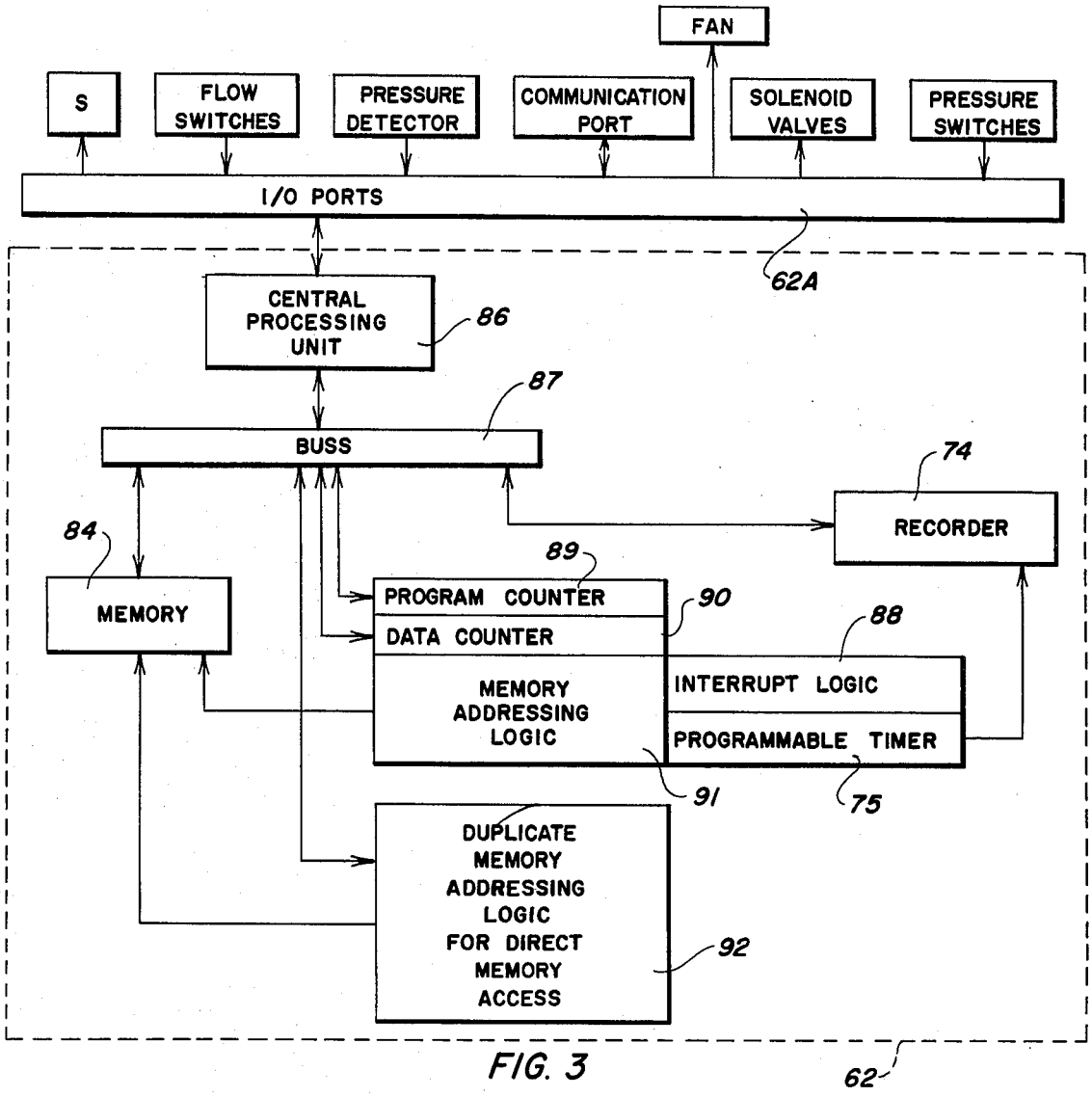
FIG. 3
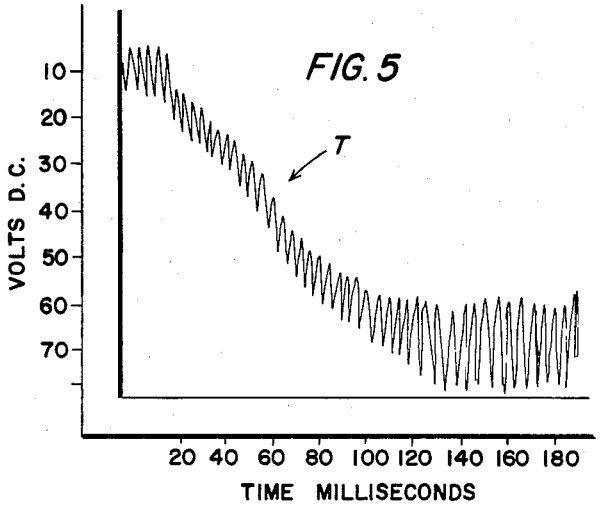
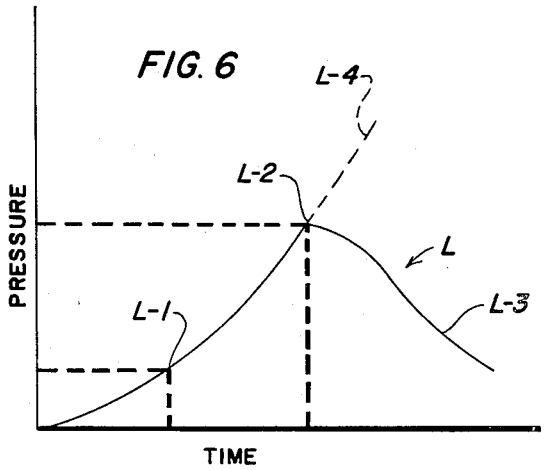

EXPOLOSION SUPPRESSION SYSTEM FOR FIRE OR EXPOLOSION SUSCEPTIBLE ENCLOSURES

BACKGROUND OF THE INVENTION

It is well recognized that a dust laden atmosphere in a closed area is a prime condition for a destructive explosion if a spark is struck in the area. Numerous destructive explosions occure in grain elevators because the conditions are just right. Another prime enclosure for destructive explosion events is the grinding or shredding chamber of mills, where trash is shreaded by rapidly rotating hammers which generate a high level of sparks.

It is known that in trash collecting and disposal operations, items like paint thinner containers, ether containing bottles, aerosol cans and other containers charged with hydro-carbons are picked up with combustible components. When these collectibles are thrown into a shredder or grinder for reduction by hammers, there is a constant sparking condition. When the conditions are correct an explosion can be created by some component catching fire to act as the detonator for an explosion. Thus, an industrial explosion is set off by rapid propagation of the flame front.

It is known that an industrial explosion, whether it is in a grain elevator, a trash shredder, or other place, is preceeded by rapid pressure increase measured in thousandths of a second before the pressure created by the fire reaches damaging proportions. It is within this very short time period that something needs to be done to quench the fire and flame propagation. The well known Fenwal explosion suppression system was developed to detect pressure rise and release a fire quenching agent into the area where the fire exists. Fenwal is the registered mark of Fenwal Incorporated Division of Walter Kidde & Co., of Ashland, Mass.

The components of substantially all of the Fenwal systems include containers for the suppressing agent which must be maintained under pressure. The containers are provided with blow out rupture discs which release the agent. Since the system is under substantial pressure for rapid delivery of the flame quenching agent, the rupture disc pieces can act as shrapnel and inflict damage to nearby persons. Also the containers are sufficiently heavy to require hoisting equipment for their installation and removal, and superstructure is required to allow persons to reach the sites of the containers. In addition, after an explosive condition has been sensed and the agent bromochloromethane released, it requires a considerable period of time (measured in days) for service people to reach the scene and recharge the system before giving approval for resumption of operations. All of the above is extremely expensive and requires the operation to be shut down. Also, when resetting the system components, the explosive "squibs" used to rupture the discs are dangerous and require the installation of persons trained in the handling thereof.

BRIEF SUMMARY OF THE INVENTION

The present invention relates to a system for suppressing explosion or fires in enclosures where such conditions are apt to exist, and is an improvement over the apparatus and system disclosed by Williams in application Ser. No. 033,433 filed Apr. 29, 1979.

The system for suppressing fire and explosion is operative in a period of time before damage can take place which means that the flame which has started the rapid pressure rise signalling the on-set of an explosion must be quenched within a time span that is measured in milliseconds. The operative components must be capable of responding in that extremely short duration time span so that a flame quenching agent can be released at the flame location and surrounding area to quench the flame and arrest the pressure rise before it can do damage to the structure forming the enclosure. The type of structure the present system is capable of protecting can include trash shredders, grain elevators, bag houses, wood turning mills, petrochemical plants, and many types of industrial operations where the contents of the atmosphere is presented to flame starting static sparks and sparks generated by other means.

A good example of the present invention may involve protecting a trash shredder where ignitable substances are present during the shredding operation. Such substances are present in aerosol containers, and the shredding necessarily is accompanied by constant showers of sparks from the hammers striking metallics, stones and such items. The protection of the shredder is accomplished by the placement of several pressurized containers holding a flame quenching agent connected to the shredder enclosure through a high speed valve that is opened upon a sensed flame front or a pressure rise that experience has shown is the forerunner of an explosion. The flame front can be detected by an infrared sensor, but if it happens to be blocked by material, the pressure sensor acts as a backup means. The pressurized containers are supplied with a suppressant agent which can be water or bromochloromethane, or some equivalent agent. The pressurizing of the containers is effected by the use of nitrogen which is first admitted to the respective containers. The agent is delivered by pumping to the nitrogen in the containers can be compressed to a level which will drive the agent at high speed into the shredder or the flame area. Furthermore, the system is provided with a programmable control having a group of circuits containing system functions which are able to monitor the important aspect of the shredder protective system from a remote location. The control system can be set up to oversee the operation of the shredder installation and provide periodic checks on the conditions which must be constantly operative to provide the desired protection for what is an expensive installation.

BRIEF DESCRIPTION OF THE DRAWINGS

The present invention has been disclosed in connection with trash shredding means, wherein:

FIG. 3 is a block diagram of the components embodied in the processor;

FIG. 5 is a graph illustrating the action of the fast-acting valve in relation to the information showing the pressure drop versus time in discharging the suppressant agent; and FIG. 6 is a graph depicting the pressure condition versus time for the suppressant agent to control the pressure rise in the closed space.

DESCRIPTION OF THE EMBODIMENT

Figures 1, 4:
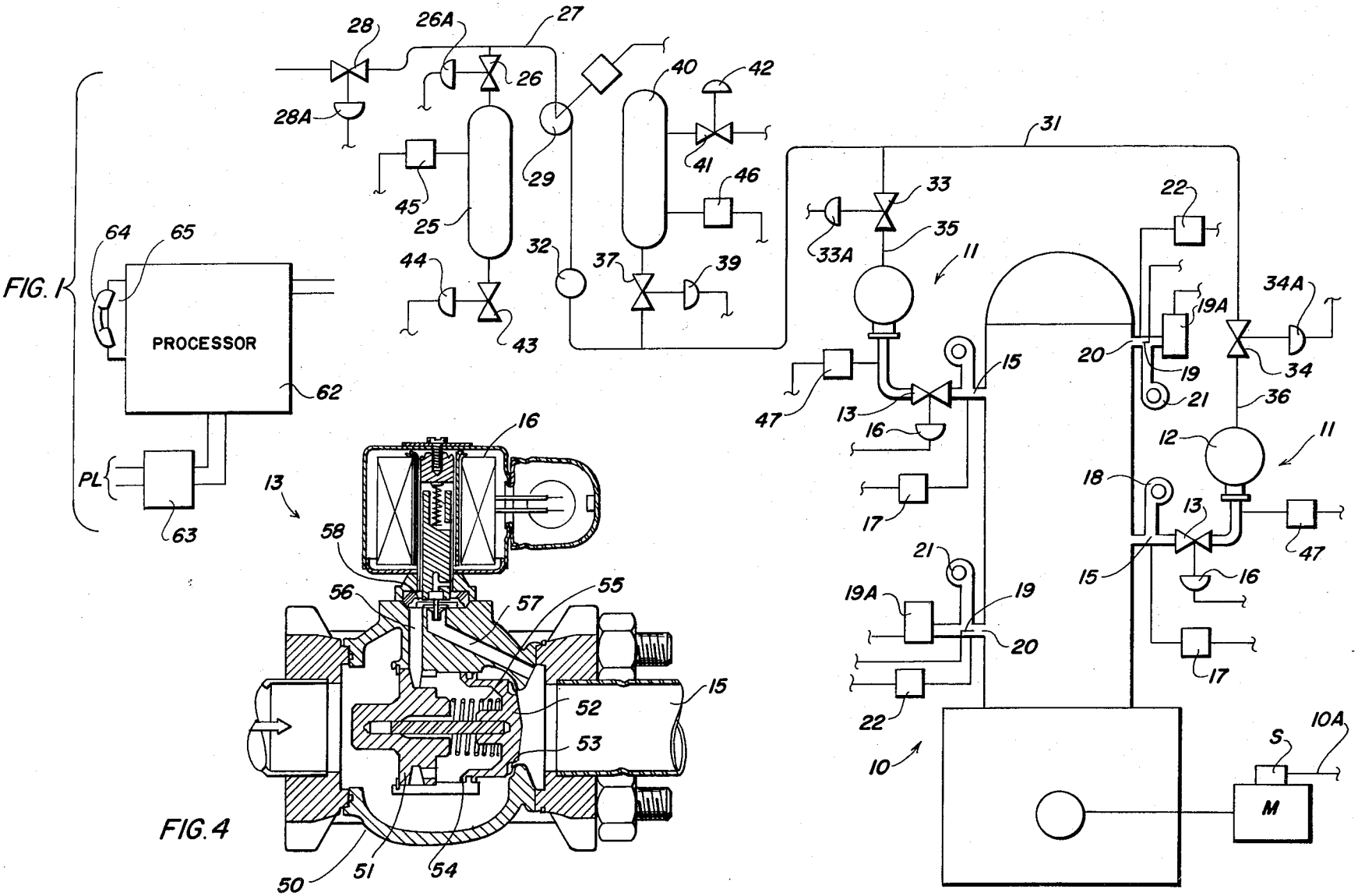
FIG. 1 is a general diagram illustrating the fire and explosion suppression system associated with a shredder.
FIG. 4 is a schematic view of a fast-acting valve for admitting suppressing agent to the area where a flame is generated.

An embodiment of the present invention is shown in FIG. 1 in connection with its utility with a material shredder 10 which is designed to grind waste material of all kinds, including material which can generate sparks when hit by the rapidly rotating hammers. The shredder 10 may be of the character shown in Williams U.S. Pat. No. 3,981,454 issued Sept. 21, 1976, or as shown in Williams U.S. Pat. No. 3,806,048 issued Apr. 23, 1974, or as shown in Williams U.S. Pat. No. 3,667,694 issued June 6, 1972. These examples are cited by way of illustrations and are not to be considered as imposing restrictions on the apparatus which is to be the subject of explosion and fire suppression.

The problem which this invention overcomes is not only to be able to detect a flame front, but to anticipate the possibility of an explosion and react rapidly to suppress that event before it can generate damage, to be able to monitor the safety means provided for suppressing explosions, and to restore the safety means quickly and from a remote location. A further problem which this invention overcomes is to avoid as much as possible the need for people to be exposed to hazards in and about the shredder installation during a period when the fire and explosion suppressing system is being rehabilitated after being set off.

In FIG. 1 the shredder 10 is provided with a plurality (two being shown) of explosion suppression units 11, each of which includes a pressure vessel 12 connected through a high speed valve 13 to the adjacent interior, such as near the entrance of the material to feed stack 14, and adjacent the shredder 10. Each valve is in a conduit 15. The high speed valve 13 is self closing by resilient means, and is opended by an operating motor 16, while the conditions in conduit 15 is monitored by a transducer 17 which responds to the pressure condition in conduit 15. A blower 18 has its outlet connected into the conduit 15 for the purpose of creating the flow necessary for proving that the conduit 15 is not blocked. The two units 11 are disposed in different locations to be ready to deliver a suppression agent contained under pressure in the pressure vessels 12. The agent may be bromochloromethane or an equivalent agent in liquid form which on release into the adjacent area is substantially atomized.

The key to the operation of the release of the suppression agent from the vessels 12 is the presence of one or more (two being shown) flame front detectors 19 which can be an infrared sensor working in conjunction with a pressure rise detector device 19A connected by a conduit 20 to the area in the apparatus where the flame front or the pressure rise preceeding an explosion is most likely to have its origin. The flame front detector 19 is mounted adjacent the conduit 20 where it can see into the adjacent area without obstructing the conduit. Each conduit 20 is tested for obstruction, other than the detector 19, by a blower 21 having its outlet connected into the conduit 20, and each has a pressure transducer 22 connected to the conduit 20 to respond to pressure conditions and create a record of what took place at that zone of the apparatus. The conduit 20 must be substantially free of obstruction for the proper operation of the infrared sensor 19, pressure detector 19A and the transducer 22. Typically in studies done on explosion reactions, it is recognized that the pressure wave associated with a fire or flame front in an enclosed space travels faster than the flame propagation. A transducer instrument is used to make a record of the events by showing pressure versus time relationships.

The most frequently used explosion suppression system involves pressurized containers of a suppression agent having a blow-out disc that is ruptured by an explosive cap called a squib that is set off by a pressure sensitive trigger upon a pressure rise of approximately one half pound per square inch. The recharging of the containers requires the handling of the agent, setting a new disc and its explosive rupturing squib in place, pressurizing the assembly, and reconnecting the current lead which ignites the squib after the containers have been replaced in operative positions. Since this activity must be done manually there is some danger of accidentally blowing the disc which will scatter its parts like shrapnel. Also, in these prior systems the pressurized containers must be removed from their operating locations for recharging, and then be returned, all of which requires the use of personnel to disconnect and connect the containers and the use of hoist equipment to move the containers. While all of these steps are being followed, the system must be shut down, and only after the safety components have been reinstalled and all piping and electrical connections check can the system be put back in operation.

Referring again to FIG. 1, the present system is provided with a container 25 of fire suppressing agent, which may be Halon, connected through a control valve 26 to a feed conduit 27. There can also be a connection through a control valve 28 with a source of water. The valve 26 has a motor 26A and valve 28 has a separate motor 28A. The conduit 27 is connected to the inlet of a pump 29 which operates under the control means 30 to supply either Halon or water into a supply line 31 past a check valve 32. The supply line 31 is connected to valves 33 and 34. The valve 33 operated by motor 33A is connected into the vessel 12 at conduit 35, and valve 34 operated by motor 34A is connected into vessel 12 at conduit 36. The supply line 31 is connected by valve 37 operated by motor 39 to a container 40 charged with nitrogen from a supply through valve 41 operated by motor 42. The container 25 is supplied by valve 43 operated by motor 44 with Halon. The contents of container 25 is monitored by a pressure transducer 45, and the contents of container 40 is monitored by a similar transducer 46. Each high speed valve 13, in the initial installation of the present system, can be tested for complete closure by first releasing nitrogen, which is relatively inexpensive when compared with Halon, or bromochloromethane, into the vessels 12 by opening valve 37, while maintaining valves 26 and 28 closed and with pumps 29 shut down. Nitrogen is used to pressurize the vessels 12 up to approximately 10 pounds, or some suitable pressure level, which will show that the valves 13 are closed. This testing is carried out one at a time by operation of the valves 33 and 34 in sequence so a defective valve 13 can be found. Normally, any residual agent in the conduit 31 may be moved into the vessels 12 when the nitrogen agent is delivered to bring the vessels 12 up to operating pressure.

After desired quantities of nitrogen have been delivered to the respective vessels 12 for testing the closure of valves 13 the valve 37 is closed and the pump 29 is operated to deliver either Halon or water to the vessels 12 to pressurize them by delivery of medium from source 25 through valve 26 operated by motor means 26A, or with water by opening valve 28 operated by motor 28A. The Halon source 25 is monitored by pressure sensing means 45 which signals when the source 25 needs to be replenished. The nitrogen is stored at source 40 at a high pressure so that when pressure of the order of 300 pounds pressure is reached in vessel 12 pressure transducers 47 will generate signals to effect closure of valves 33, 34 and 37.

The foregoing description has called for a number of transducer devices for monitoring pressure conditions at various places in the system seen in FIG. 1. These transducers may be any such devices used for measurement of static and dynamic pressures in liquid and gas systems for supervisory, analog, and computer inputs. A typical transducer may be the Model 2900 of Industrial Instruments by Bourns which is a solid state device. In this device pressure is applied to one side of a machined metal diaphragm which strains a silicon semiconductor element located at the opposite side. The change in resistance due to the piezoresistive effect produces a signal output which is linear with pressure when excitation is applied. The signal output is temperature compensated to minimize the effect of environmental or media temperature variations.

FIG. 4 is a view of a typical fast action valve 13 connected by conduit 13A to a container 12. The valve body 50 carries a support structure 51 for a valve element 52 which closes the port 53 at the downstream or outlet side connected to conduit 15. The valve element 52 has a bleed passage 54 which allows the pressure fluid as the inlet side of the valve 13 to build up behind the valve element 52 to work with a resilient spring 55 in holding the valve element closed. The space behind valve element 52 communicates with passage 56 and passage 57, the latter passage opening to the outlet side of the valve 13. However, normally passages 56 and 57 are not in communication due to the presence of a pilot valve 58 blocking such communication. The pilot valve 58 is moved to open position by motor means 16 which may be a solenoid for substantially instantaneous actuation of the pilot valve 58. The opening of the pilot valve 58 allows the high pressure at the inlet side to the valve to unseat the valve element 52 against the closing thrust of the spring 59. The opening of valve 13 allows the agent under pressure in the associated container to be dumped into the area where sensors have reacted to a rise in pressure of a significant valve, or a flame front has been detected.

FIG. 5 is a graph of the reaction of the transducer 17 connected into outlet conduit 15 from the time the valve element 52 began its opening function to release the pressurized agent from container 12 to the time when there developed a back pressure from the area at the end of the conduit 15. The graph represents the oscilloscope trace T of the pressure drop versus time. The transducer 17 produces a signal voltage D.C., and as the pressure drops during the expulsion of the agent it can be seen that at about 120 milliseconds the agent has been substantially fully delivered. The trace T beyond 120 milliseconds illustrates the presence of a back pressure in the conduit 15.

The graph of FIG. 6 is an illustration of the events of pressure rise versus time in relation to the suppression of pressure rise. The graph line L represents the pressure curve plotted against time to indicate that when a transducer senses a rise in pressure at approximately the point L-1 the fast acting valves 13 are operated to discharge the agent into the area where the pressure rise has been sensed. Normally the agent will immediately begin to suppress fire or the cause of the pressure rise while the pressure increase with lapse of time follows the full line curve L to approximately the pressure level represented by the point L-2. At about that time in tracking the pressure condition the suppressing agent should have taken effect so that the result will be to find that the pressure has peaked and is decreasing in relation to time along the line L-3. However, if the cause of the pressure rise involves material carrying its own oxygen, there is not much that the agent can do to suppress the pressure rise and the result is that an explosion will take place because the pressure rise will continue to increase along the broken line L-4.

Figure 2:
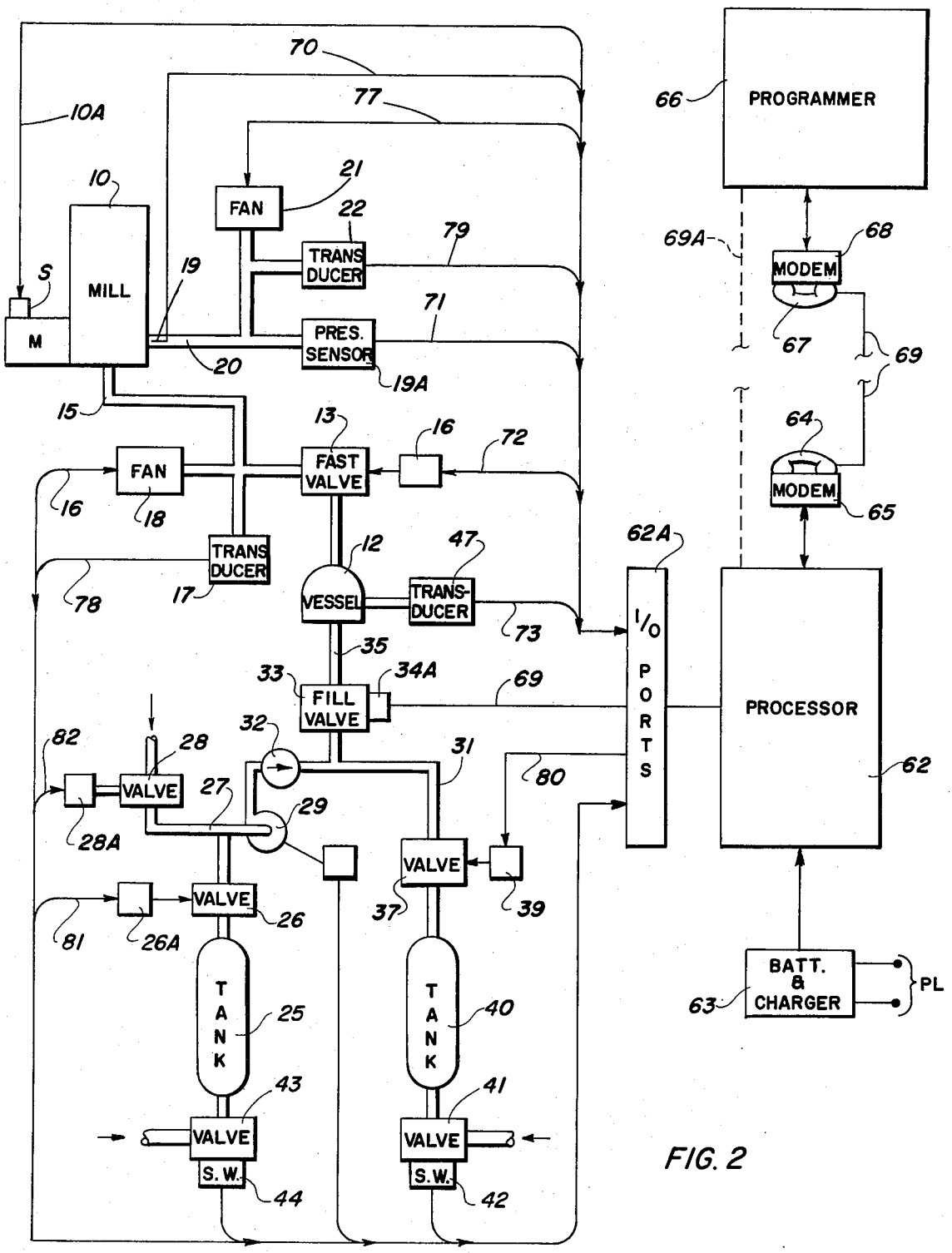
FIG. 2 is a schematic block diagram of the elements, components, and controls for the system of FIG. 1.

As indicated in FIGS. 1 and 2, the system includes a control center 62 to which signal transmitting lines, seen in fragmentary form, are connected from the respective motor means and transducers scattered about the system. The control center is provided with electrical power input lines PL to a power supply 63 which includes a primary battery supply connected to an AC charger (not shown) so that the control center may operate at all times from the battery supply and the charger will keep the battery charged up. The power supply 63 is arranged so that a low level current will be available to test the continuity of all electrical leads without actually operating the motor means.

The purpose of the control center 62 is to overcome the problems existing in current systems which require operating personnel to do everything about resetting the safety means after it has been set off. The control center is unique in that it is set to operate electronically so that all of the functioning elements, devices and means of the system are coordinated from the center. The further unique feature of the present embodiment is that after a fire or an explosion suppression cycle has occured, the operator of the mill 10 can telephone a central office of the manufacturer of the explosion suppression system, report the event of an explosion suppression, and connect the telephone instrument 64 to a modem 65 which is wired into the control center and obtain a rapid restoration of all components of the system. As will be described in FIG. 2, the modem connection is established at the manufacturers central office program panel 66 by a second telephone instrument 67 and modem 68 connected by transmission line 69.

An explosion suppression cycle would necessarily open all high speed valves 13 and empty the vessels 12 of agent. By telephone modem connection the central office could program circuits in the control center 62 to do the following things:

a. reclose all high speed valves by de-operating motor means 16.
b. turn on all blowers 18 and 21 to prove through the transducer means 17 and 22 that the conduits 15 and 20 are not clogged or obstructed with material from the inside of the mill 10.
c. apply a low current through the leads to the high speed valve motor means 16 to make sure the electrical system is intact, and test all systems to be certain there is no grounded circuit.
d. open the valve 37 at the source 40 to supply nitrogen to each of the vessels 12, in turn, by sequential operation of valves 33 and 34 until the necessary quantity of agent is loaded into the vessels 12 without loss, thereby showing the valves 13 to be closed.
e. close valve 37 at the nitrogen source 40 and, depending upon the character of material being fed to the mill 10, to open valve 26 to supply Halon, or open valve 28 to supply water to the vessels 12.

f. perform all of the foregoing steps to the control center 62 sensing a flame front at means 19 or an explosion condition by pressure rise sensed at means 19A, the control center 62 would perform its function to reapply power to the mill driving motor M so it could be started after steps a through f have been taken.

In addition to the reloading sequence the control system is designed to do the following:

a. keep track of the operating time of the mill 10 by the clock timer so that at about 100 hours of operating time the system could be required to be checked out by means of the telephone modem.
b. read the pressure devices 45 and 46 to determine that a suitable quantity of agent in source 25 and nitrogen in source 40 is available.
c. place in a memory the time and duration of any explosion or fire so that at a later date this memory area can be polled to possibly determine the type and character of explosion and its subsequent pressure buildup.
d. constantly poll all external circuits to keep a record in memory the cause and time of any system shut down.
e. internally poll all circuits and keep track of any soft errors that corrected themselves so that each 100 hours check the elements can be found and replaced.

An illustration of the remote control and monitoring provisions to be applied is shown schematically in FIG. 2, and further details are shown in FIG. 3 to which reference will be made where appropriate. It is to be understood that the control center 62 (also called processor) embodies the necessary circuits for performing the steps outlined above in monitoring the elements associated with the shredder 10 which react when the infrared sensor 19 responds to the presence of a flame or the pressure rise sensor switch 19A responds to a significant rise in the pressure within the enclosure represented by the shredder mill 10. The circuit connections between the control center 62 and the several devices seen in FIG. 1 making up the unique system are brought in through the I/O port. The infrared sensor 19 is connected into the I/O port 62A by lead 70 and the pressure sensor switch 19A is connected by lead 71. The sensors respond to impending problems within the mill 10 and send signals into the processor 62 which in turn, sends signals to offset the problem by operating the valve 13 through its solenoid motor means 16 to release the suppressing agent in the pressurized vessels 12 to the mill interior. The valve motor 16 is connected into the I/O port 62A by lead 72, and the fact of the discharge of the agent from the vessel 12 is monitored by its pressure switch 47 which transmits a signal by lead 73 into the I/O port 62A which activate a recorder 74 and timer unit 75 which memorizes the time and duration of the event. Simultaneously with the release of some or all of the agent by valve 13, the processor 62 opens the power supply to motor M connected by lead 10A through its starting element S.

After the system has functioned to suppress a flame and stopped the ensuing explosion it is necessary for the mill operator to either sequence the processor 62 through its steps for restoring the system to operative conditions, which can be done if the programmer 66 is locally connected through leads 69A, or to telephone by phone 64 to the remote central office phone 67 and report the shut down of the mill. The operator at the central office will then instruct the mill operator to combine the phone unit 64 with the local modem 65 and the remote operator will combine his telephone unit 67 with the remote modem 68 to connect up with the modem 65 through telephone line 69. The operator at the central office can then utilize the programmer 66 to instruct the various circuits in the processor 62 to step by step be sure the high speed valve or valves 13 are closed, and turn on blowers 18 and 21 by leads 76 and 77 to test the conduits 15 and 20 for obstruction by monitoring the response signals from the respective transducers 17 and 22 through the associated leads 78 and 79. Furthermore, the processor 62 can be instructed to apply a low level current through the electrical systems associated with the mill to make sure there is no broken or grounded circuit. In addition the source of nitrogen medium 40 can be opened at valve 37 by its lead 80 to test the fact of the closure of high speed valves 13 by supplying vessels 12 until pressure responsive transducers 47 signals through lead 73 that pressure has built up in the vessel. This program of events is continued on to recharge vessels 12; either with the Halon agent from source 25 by opening valve 26 through its motor means 26A connected by lead 81, or if oxygen in the water is not objectionable by opening valve 28 by its motor means 28A connected by lead 82.

The view of FIG. 2 is simplified to show only one vessel 12, but it is understood that two or more vessels 12 can be incorporated in the system to function as described. While the agent from source 40 is recharging the vessel 12 a check valve 32 will prevent reverse flow toward the pump 29, thereby not interfering with the quantity of agent delivered to vessel 12. When recharging vessel 12 is completed, the valve 37 is closed by a signal through lead 80 to its motor 39.

The programmer 66 may be the type disclosed in Allen-Bradley Company Bulletin 1772, 5th Edition of Apr. 6, 1978, or associated Bulletins, embodying digital, electronic, solidstate systems. The programmer 66 is connected, as indicated, to the processor means 62 which reads input signals and generates output commands by interpreting instructions from the programs stored in a memory 84 (FIG. 3). There is also the I/O port 62A forming the interface with the external devices to be controlled and monitored. This I/O port 62A receives information in the form of electric signals from the components in the system of FIG. 2, and it also transmits action signals to those components. The programmer 66 contains the programming, editing and monitoring components of the complete system. The programmer 66 includes a keyboard (not shown) through which instructions are entered into the memory 84 through unit 86 (FIG. 3). Processor 62 functions in association with the foregoing programmer 66 to examine one instruction at a time, and to execute the necessary instruction before advancing to examine and carry out the next instruction. The instructions to be carried out through cooperation of programmer 66, the processor 62 and the external devices of FIGS. 1 and 2 through the interface I/O ports 62A have been set out above. Among the desired instructions are those in which the system of FIGS. 1 and 2 can be monitored at stated time intervals, say 100 hours of operating time of mill 10, to determine if components of importance are still functional and if there are any soft errors in the system. It is also important to know if the tanks 25 and 40 are sufficiently charged to guard against the lack of an adequate supply of suppression agent and nitrogen.

Turning now to FIG. 3, the processor 62 is seen to embody a central processing unit 86 connected through a buss 87 to the memory 84, the recorder 74, the programmable timer 75 and to the interrupt logic 88, program counter 89, data counter 90, memory addressing logic 91, and duplicate memory and addressing logic 92 for direct access to the memory 84. The means 86 is important in that it is set to operate electronically so that all of the functioning elements, devices and means of the system are coordinated in a program.

The advantage to be gained by the foregoing system is that expensive mill or shredder equipment can be protected from fire and explosion capable of being suppressed by the bromochloromethane agent if timely released into the enclosure. In addition the protective system can be constantly monitored by its processor 62 for a number of variables, and the down time of the system can be greatly reduced by use of the remote central office programmer.

The foregoing description is directed to safety means for an operating machine, such as a trash shredder, having a closed space in which fire and explosion may occur. The machine is intended to be protected by a system which senses conditions preceeding an explosion for the purpose of stopping the drive of the machine and releasing a pressurized suppression agent into the closed space at a time when possible destructive forces can be checked. The system includes a normally closed valve in the connection between the suppression agent container and the closed space for withholding the agent until it is needed to protect the operating machine, together with means for testing the communication of the sensing means with the closed space for obstructions as well as testing the communication between the sensing means and the closed space. The foregoing arrangement for protecting an operating machine is operatively connected into a processor 62 as indicated. The processor means 62 is on the premises where the machine to be protected is located, while the programmer 66 may be remotely located. If the distance is great the convenience of telephone modem means can be employed for sequentially examining the circuit connections to determine the existing operative conditions of the various means provided for protecting the operating machine.

A unique feature of the foregoing system resides in the way the vessels 12 are charged with the agent Halon. Instead of providing a metering device to monitor the quantity of agent delivered to each vessel 12, the ratio of Pressure and Volume to Temperature can be relied upon. Each vessel 12 will have a known volume, and at any recharging time, the local temperature will have a known value. Thus, by knowing the "gas constant" for Halon or the bromochloromethane, the volume of the charge can be calculated by the P, V, T relationship, where $$(P \times V)/T = R$$

or $$V = (R \times T)/P$$

In that equation, all of the factors R, T and P will be known so it is easy to determine the volume of the charge of agent at the level of about 300 pounds pressure.

The system is to operate by using a sufficient volume of nitrogen at a pressure of about 10 psig to test closure of the valves 13, followed by charging the vessels 12 with the agent directly from tank 25 and monitoring the volume of the charge by sensing the rise in pressure by the pressure transducers 47 to cut off charging at the desired level of 300 psi, or some desired pressure. The transducers 47 can be continually monitored through the processor means 62 to take into account the drop in pressure due to nitrogen dissolving into the agent or change in pressure due to ambient temperature changes. For too great pressure the vessels 12 can be bled off and for a drop in pressure more nitrogen or agent can be admitted.

The invention is directed to a unique method of examining the functionality of a plurality of protecting agencies associated with a closed space or with an operating machine having an enclosed space in which fire or a destructive force may occur by reason of a flame front generating a pressure condition within the closed space. This unique method embodies means adjacent the closed space for continuously monitoring for the presence of a flame or the pressure condition, sensing the presence of a flame or an abnormal pressure rise, rapidly releasing a pressurized suppression agent into the closed space to arrest the flame front and its resulting pressure increase, recording the time and duration of the event of the release of the agent in a remotely located processor unit, recording the time and duration of the pressure condition as in FIGS. 5 and 6, and submitting the processor to a remote preprogrammed unit for operative conditions respecting the functionality of the plurality of agencies, a periodic timer for maintenance checks, or following the event of the release of some or all of the suppression agent.

What is claimed is:

1. In a safety system for apparatus operating to reduce waste material and having a chamber in which waste material is reduced, the combination therewith of: a container for a pressurized protective agent connected to said chamber by a conduit; a normally closed valve in said conduit withholding said pressurized protective agent from the chamber; pressure responsive means connected to said conduit between said closed valve and said container for monitoring the pressure existing in said container; a source of pressurizing medium; a source of protective agent; conduit means connecting said pressurizing medium source and said protective agent source to said container; flow control valve means in said conduit means operable for permitting the transfer of said pressurizing medium and protective agent to said container; and central control means operably connected to each of said normally closed valve, pressure responsive means and said flow control valve means for admitting pressurizing medium to said container, said normally closed valve retaining the pressurizing medium in said container at a predetermined pressure, subsequently admitting protective agent to said container to be subjected to pressurization by said medium, and monitoring the response of said pressure responsive means upon admitting of said agent for operating said flow control valve means to closed position upon attaining a rise in pressure in said container of a predetermined amount.

2. A safety system of claim 1, wherein said medium source is an inert material stored under pressure.

3. The safety system of claim 1, wherein said protective agent is a chemical composition.

4. The safety system of claim 1, wherein said protective agent is water.

5. The safety system of claim 1, wherein said container has a fixed volume, and the amount of protective agent to be admitted to said container is measured by the response of said pressure responsive means.

6. In an explosion suppression system for enclosures susceptable to fire and explosion, the combination with the enclosures of: a container having an outlet conduit connected to said enclosure and an inlet conduit; a first normally closed valve in said outlet conduit; a second valve in said inlet conduit; a source of a pressurizing medium; a source of a fire and explosion suppression agent; valve means selectively operable for connecting said pressurizing medium and said suppression agent to said inlet conduit for admission to said container through said second valve; pressure responsive means connected into said inlet conduit between said container and said first valve; and central control means operably connected to said first and second valves, said selectively operable valve means and said pressure responsive means for operating said selectively operable valve means and said second valve to admit pressurizing medium to said container, said normally closed first valve retaining the pressurizing medium in said container at a predetermined pressure.

7. In a fire and explosion suppression system for protecting an enclosure against destructive forces, the combination with said enclosure in which the system comprises: a container having a fixed volume for receiving a charge of a fire and explosion suppression agent; a connection between said container and the enclosure including a valve normally closed; means responsive to a destructive condition in the enclosure for opening said normally closed valve to release the agent into the enclosure; a source of pressurizing medium; a source of suppression agent; common conduit means connecting said source of pressurizing medium and said suppression agent to said container; operating connections with said sources of agent and medium for effecting selectively the initial pressurizing of said container with pressurizing medium up to a predetermined pressure and the subsequent charging of agent into said container; pressure responsive means connected to said container to respond initially to the retention of said medium by said container at a predetermined pressure, and to subsequently respond to the admission of said agent for terminating the admission of said agent at a selected pressure level; and central control means operably connected to said system for monitoring the operation thereof such that said normally closed valve is effectively closed and the quantity of said agent in said fixed volume container is known.

8. In a safety system for apparatus operating to reduce waste material and having a reduction mill, a waste material feed stack opening to the mill, and waste material inlet to the feed stack, the improvement which comprises: a plurality of containers for holding a fire and explosion suppression medium under pressure, said containers being scattered about the apparatus; a connection between each of said containers and the apparatus; valve means in each connection for releasing the pressurized medium from at least some of said containers into the apparatus; first means operably connected to the apparatus for sensing the development of a fire; second means operably connected to the apparatus for sensing pressure buildup beyond a predetermined minimum level; third means connected to said valve means for operating the same to effect release of pressurized medium from said containers into the apparatus; processor means operatively connected to said first, second and third means for monitoring the operation thereof, whereby events within the apparatus sufficient to effect response of any of said first, second and third means are tracked and recorded.

9. The safety system improvement set forth in claim 8, wherein said processor means includes memory means and recorder means operable for tracking events in the mill and feed stack causing operation of any of said first, second and third means.

10. The safety system improvement set forth in claim 8, wherein a remotely located preprogrammed unit is operatively connected to said processor means for polling said processor means, whereby said safety system is subjected to examination as to its operability.

* * * * *

UNITED STATES PATENT AND TRADEMARK OFFICE

CERTIFICATE OF CORRECTION

PATENT NO. : 4,281,717

DATED : August 4, 1981

INVENTOR(S) : Robert M. Williams

It is certified that error appears in the above-identified patent and that said Letters Patent are hereby corrected as shown below:

In the title the word "EXPOLOSION" should be -- EXPLOSION-- in both instances.

Column 1, line 12, "shreaded" should be -- shredded --.

Column 2, line 36, "by pumping to" should be -- by pumping so --.

Column 5, line 53, "represents the" should be -- represents an --.

Column 10, line 65, Claim 2, "A" should be -- The --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*